United States Patent [19]

Larronde et al.

[11] Patent Number: 4,790,393

[45] Date of Patent: Dec. 13, 1988

[54] VALVE FOR DRILLING FLUID TELEMETRY SYSTEMS

[75] Inventors: Michael L. Larronde; Manmohan S. Kalsi; M. Vikram Rao, all of Houston, Tex.

[73] Assignee: NL Industries, Inc., New York, N.Y.

[21] Appl. No.: 460,461

[22] Filed: Jan. 24, 1983

[51] Int. Cl.[4] ..... E21B 21/10

[52] U.S. Cl. ..... 175/40; 175/48; 251/329

[58] Field of Search ..... 175/40, 45, 50, 48; 251/89, 137, 327-329; 367/81-85

[56] References Cited

U.S. PATENT DOCUMENTS

| | | | |
|---|---|---|---|
| 2,426,392 | 8/1947 | Fennen | 251/329 |
| 3,356,334 | 12/1967 | Scaramucci | 251/329 |
| 3,389,355 | 6/1968 | Schroeder | 251/137 |
| 3,469,818 | 9/1969 | Cowan | 251/327 |
| 3,482,816 | 12/1969 | Arnold | 251/329 |
| 4,078,620 | 3/1978 | Westlake et al. | 175/48 |

*Primary Examiner*—Jerome W. Massie
*Assistant Examiner*—William P. Neuder
*Attorney, Agent, or Firm*—Browning, Bushman, Zamecki & Anderson

[57] ABSTRACT

A mud pulse telemetry system for imparting data pulses to drilling fluids circulating in a drill string including an improved valve arrangement for modulating the pressure of the circulating drilling fluid is disclosed. A shear-type valve is arranged in a through conduit configuration so that the seat face of the valve is covered when the valve is in an open position, thus preventing impingement of abrasive fluid particles on the valve seat face during the open flow position of the valve. The activation means is connected to the valve gate through a floating connection which prevents lateral stress forces operating on the valve from being imparted to the solenoid. The floating connection also permits convenient removal of the valve seat and gate from an access opening on the exterior of the drill string housing to facilitate the replacement of critical valve parts without removing the valve subassembly from the drill string. The valve gate and seat have an oblong valve flow opening therein which provides for sufficient fluid flow to adequately modulate the fluid pressure and at the same time provide a minimum length of stroke for the solenoid to operate the valve. An upset rim on the valve seat provides a seating face smaller than the opposing seating face of the gate.

20 Claims, 2 Drawing Sheets

VALVE FOR DRILLING FLUID TELEMETRY SYSTEMS

BACKGROUND OF THE INVENTION

1. Field of the Invention

The present invention relates to a drilling fluid telemetry system and, more particularly, to a valve for modulating the pressure of a drilling fluid circulating in a drill string in a well bore.

2. Description of the Background

Drilling fluid telemetry systems, referred to as mud pulse systems, are particularly adapted for telemetry of information from the bottom of a borehole to the surface of the earth during oil well drilling operations. The information telemetered often includes, but is not limited to, parameters of pressure, temperature, salinity, direction and deviation of the well bore, bit conditions and logging data, including resistivity of the various layers, sonic density, porosity, induction self potential and pressure gradients.

In previous borehole telemetry systems, it was first necessary to pull up the drilling pipe section by section including the drilling bit to completely vacate the drilled hole prior to making measurements of important parameters at the bottom of the borehole. Sensors were then lowered down to the bottom of the well on a wireline cable, the measurements were taken, the sensors and wireline were removed and finally the bit and drilling pipe was reassembled and put back into the hole. Obviously, these procedures were extremely expensive and time consuming as a result of the cessation of drilling operations during measurement times.

These problems have led to research in borehole telemetry systems in which the drilling pipe and bit do not have to be removed from the well before measurements are made. Attempts have been made to telemeter data by means of sonic waves traveling through either the drilling pipe or through the drilling mud present both inside and surrounding the drilling pipe. Unfortunately, the drilling mud is a strong sonic dampening medium and substantially attenuates the sonic waves before they can travel a usable distance. Acoustic systems using the drill pipe as the conductor require the use of repeater subs in the pipe string and are electrically complicated. No commercial acoustic system has yet been developed. Total useful telemetry depth with these systems is less than minimally needed in a practical operation.

Other proposed systems have employed an electrical conductor installed either inside or outside the drill pipe or the casing pipe. Unfortunately, the physical forces encountered in a borehole drilling operation inside the well bore and the cuttings and other debris brought up from the bottom of the well bore often produce malfunctions in the conductors and associated electrical connectors.

Another proposed system utilizes a conductor inside of each section of drill pipe with transformer coupling between sections of pipe. Besides requiring expensive modifications to the drill pipe, these systems are unreliable because the magnetic coupling between sections if frequently hindered by mechanical misalignment between drill pipe sections and because the alignment of coupling coils with one another is difficult to achieve.

Still other proposed systems employ either the drilling pipe or casing pipe as one of the conductors in an electrical transmission system. The earth itself may form the other conductor. Unfortunately, the conductivity of the earth is unpredictable and is frequently too low to make this system practical at typical borehole depths. Still further, these systems often include a single wire along the casing pipe or drilling pipe. These systems suffer from the problems discussed above with the hard wire systems. Both of these systems suffer the additional common problem that the conductivity between pipe sections is greatly affected by the presence of contaminants on the pipe joints. Frequently the resistance of the pipe joints is too high to permit telemetry using any practical power levels.

Still other proposed systems involve various electromagnetic transmission schemes for directing electromagnetic signals up the pipe string to the surface, either through the pipe or mud. These systems, similar to the sonic systems discussed above, are complicated by attempts to overcome the attenuating affects of these transmitting mediums.

At present the only drill string telemetry systems which have achieved commercial success are those related to mud pulse telemetry. One example of such a prior mud pulse system is illustrated in U.S. Pat. No. 3,964,556 which requires that circulation of drilling fluids be ceased in order to operate the system. Other systems have used a controlled restriction placed in the circulating mud stream and are commonly referred to as positive pulse systems. With mud volume sometimes surpassing 600 gpm and pump pressures exceeding 3000 psi, the restriction of this large, high pressure flow requires very powerful downhole apparatus and energy sources. Further, these systems must deal with the movement of valve parts under such high pressure conditions, resulting in a source of problems dealing with the durability of valve parts subjected to high pressure, abrasive, fluid flow conditions.

A presently employed mud pulse system involving negative pressure pulse techniques includes a downhole valve for venting a portion of the circulating drilling fluids from the interior of the drill string to the annular space between the pipe string and the borehole wall. As drilling fluids are circulated down the inside of the drill string, out through the drill bit and up the annular space to the surface, a pressure of about 1000 to about 3000 psi is developed across the drill bit. Thus, a substantial pressure differential exists across the wall of the drill string above the drill bit. By momentarily venting a portion of the fluid flow out a lateral port above the bit in the drill string, a momentary pressure drop is produced and is detectable at the surface to provide an indication of the downhole venting. A downhole instrument or detector is arranged to produce a signal or mechanical action upon the occurrence of a downhole detected event to produce the above-described venting. As may be readily appreciated by those skilled in the art, the sophistication to which this signalling may be developed is practically unlimited.

A major problem associated with negative pressure pulse systems is the wear and replacement of valve parts, particularly as the data rate is expanded. It is highly desirable to operate such a system as long as possible since replacement of system components typically requires the time consuming and expensive removal of the valve system from its downhole location and from the drill string at the surface.

One negative pulse system uses a poppet valve having a circuitous flow path through the valve. The seat of the poppet is worn rapidly by high rates of abrasive fluid flow when the valve is in the open position. In addition, it is desirable to have a fast acting opening and closing movement of the valve parts in order to create a sharp pressure pulse for adequate detection at the surface. Rapid closing of the poppet valve generates a high valve head impact force on the seat. This force rapidly wears the valve parts, particularly when abrasive particles are present in the fluid flow through the valve. Such particles become impacted in the valve parts and deteriorate the sealing surfaces of the valve. The repeated impact forces may also break portions of the valve parts because erosion resistant materials are generally not impact resistant.

Another negative pulse system employs a rotary acting valve which as a result of the mass of rotary valve parts and the motor system used to operate the valve is a slow acting system.

These examples illustrate some of the crucial considerations that exist in the application of a rapidly acting valve to a fluid flow to generate a sharp pressure pulse. Other considerations in the use of these systems in borehole operations involve the extreme impact forces and vibrational forces existing in a drill string application and resulting in excessive wear and fatigue to operating parts of the system. The particular difficulties encountered in a drill string environment, including the requirement for a long-lasting system to prevent premature malfunction and replacement of parts require a simple and rugged valve system.

The present invention overcomes the foregoing disadvantages and provides a new and improved mud pulse telemetry system having an improved shear type valve gate which is simple, durable, efficient and conveniently serviceable.

SUMMARY OF THE INVENTION

The present invention contemplates a drilling fluid telemetry system utilizing a shear type valve arranged having a straight through fluid flow path to minimize pressure losses in the valve and maximize pressure modulation by the action of the valve. The improved shear type valve includes a through conduit gate which covers a raised rim about the opening of the valveseat face when the valve is in an open, flow condition.

One feature of the invention includes the operation of the valve by a means such as a solenoid having an actuating stem operably connected to the valve gate by a floating connection which isolates the solenoid armature from lateral forces applied to the valve gate. The valve gate is constantly urged into contact with the valve seat by a biasing force.

Another feature of the invention is the designing of gate and seat opening geometries and valve actuating means to minimize the opening and closing times in order to minimize the time that the seat is subjected to erosive wear by the drilling fluid. In a preferred embodiment the valve opening in the through conduit gate and in the seat are arranged in an oblong configuration which maximizes flow rate through the valve for a minimum amount of travel of the solenoid stem and gate to conserve energy utilized to operate the system.

The invention further features an access opening in the side of the tool housing which in turn is on the outside of the drill string to permit removal of the valve wear components without removing the valve assembly from the pipe string.

These and other meritorious features and advantages of the present invention will be more fully appreciated from the following detailed description and claims.

BRIEF DESCRIPTION OF THE DRAWINGS

Other features and intended advantages of the invention will be more readily apparent by the references to the following detailed description in connection with the accompanying drawings wherein.

While the invention will be described in connection with the preferred embodiment, it will be understood that it is not intended to limit the invention to that embodiment. On the contrary, it is intended to cover all alternatives, modifications and equivalents as may be included within the spirit of the invention as defined in the appended claims.

DESCRIPTION OF THE PREFERRED EMBODIMENT

Figures 1, 3:
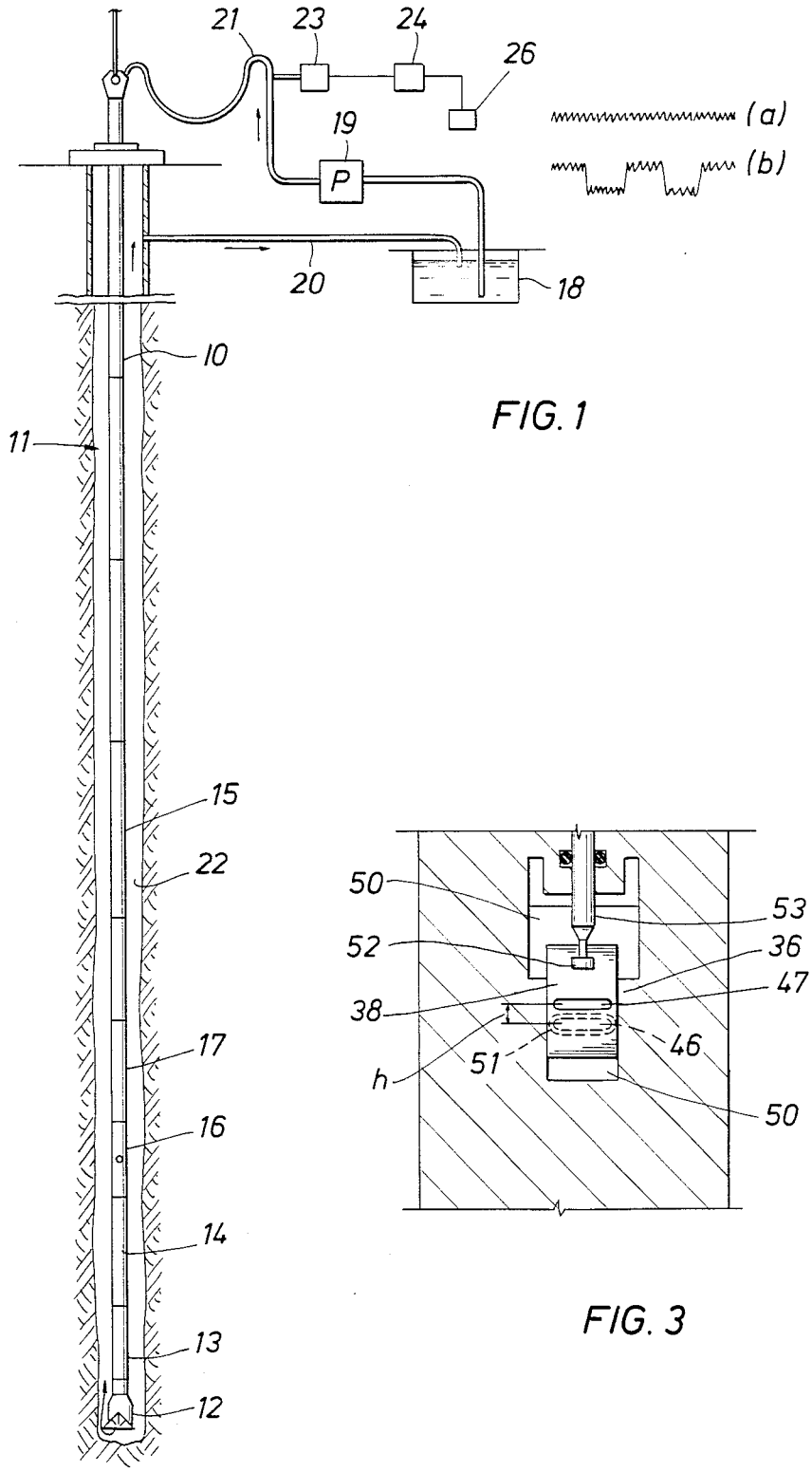
FIG. 1 is a schematic drawing of a drill string utilizing the pressure pulse valve of the present invention and illustrating surface equipment for receiving telemetered data from downhole.
FIG. 3 is a section taken along lines 3—3 of FIG. 2 showing the face of the valve seat and the oblong through conduit opening in the valve.

Referring first to FIG. 1 of the drawings, a drill string 11 is schematically illustrated as including sections of drill pipe 10 suspended from a drilling platform at the surface and having drill collars 15 together with various downhole subassemblies at the bottom of the drill string. The downhole assembly includes bit 12 at its lower end, above which is located bit sub 13. Bit sub 13 may house borehole parameter detecting instruments. Next in the string is illustrated power supply sub 14 and above that valve subassembly 16 which is the subject of the present invention. Instrument sub 17 houses associated electronics for encoding information indicative of detected data into a format which in turn drives valve subassembly 16 to impart data to the drilling fluid for telemetry to the surface. The drilling fluid or mud is circulated from storage pit 18 or the like at the surface by means of pump 19 which moves the mud through stand pipe 21 into the drill string. The mud is carried through the string of hollow pipe comprising the drill string to the bottom of the borehole where it exits through drill bit 12 carried on the bottom of the drill string. As the mud passes through bit 12, it experiences a substantial drop in pressure as it moves into the enlarged space of borehole annulus 22 surrounding the drill string. The mud then carries cuttings from the bottom of the borehole to the surface where they are removed and the mud is returned to pit 18 by conduit 20.

Valve assembly 16 includes a bypass passageway which serves to connect the interior of the drill pipe fluid flow path with borehole annulus 22. A sufficient volume of mud can be vented through valve 16 to cause a modulation of the mud pressure detectable at the surface. Transducer 23 is located in stand pipe 21 at the surface for detecting such modulations of pump pressure in order to receive data transmitted from downhole. The output of transducer 23 is decoded by surface electronics package 24 and the processed signals are then passed to readout equipment 26. A schematic format of an analog readout is illustrated in FIG. 1 adjacent electronics package 24. The top line (a) illustrates the pressure fluctuations that typify the normal oscillating pressure drop seen across the drill bit. Line (b) illustrates the effect on surface pressure caused by venting fluid through valve assembly 16 downhole. Simplistically, this describes a mud pulse telemetry system for utilizing the valve of the present invention in a drilling operation as will be described hereinafter in greater detail.

Figure 2:
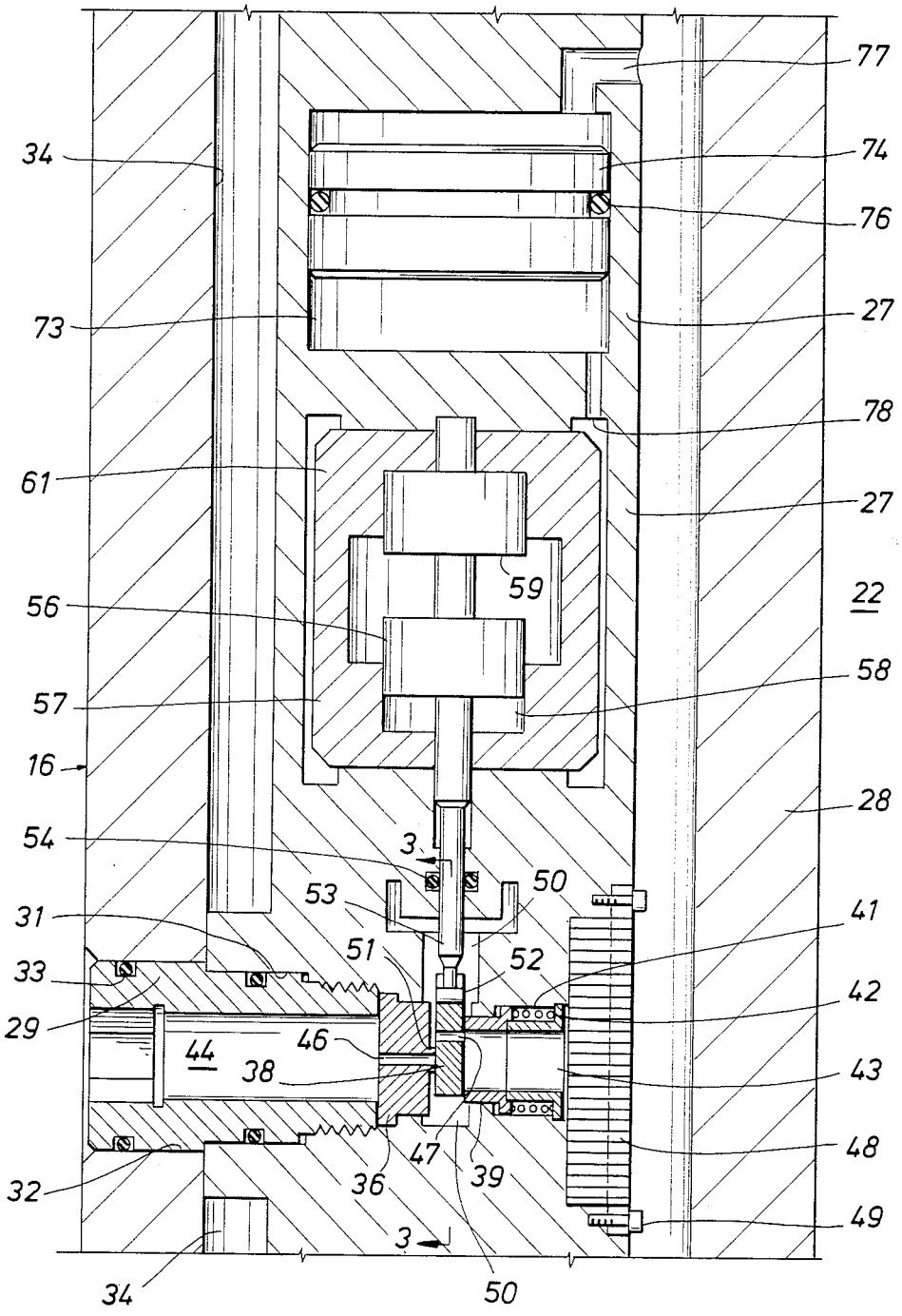
FIG. 2 is a cross-sectional elevation view of the modulating valve of the present invention.

Referring now to FIG. 2 of the drawings, the valve assembly which forms the subject of this invention is located in housing 27 which is sized for positioning within the bore of a drill collar or valve sub 16 having the dimensions of a drill collar. This assembly is then connected into drill string 11 as illustrated in FIG. 1.

Valve assembly 16 includes side port sleeve 29 which is threadedly received within shouldered portion 31 on the wall of housing 27 and is illustrated extending through aligned opening 32 in wall 28 of valve sub 16. Sleeve 29 has a hex shaped portion formed in the bore thereof to facilitate its convenient removal from wall 28 of sub 16. O-ring seal 33 is positioned between sleeve 29 and opening 32 to seal interior bore 34 of the drill string from annulus 22 between the drill string and the borehole wall. A shear valve gate 38 is mounted for reciprocating movement within a valve chamber 50. Valve gate 38 is slidably positioned adjacent seat On the other side of gate 38 opposite seat 36 is preload collar 39 which is biased by means of spring 41 into contact with the side wall of gate 38. Spring retainer sleeve 42 which is threadedly attached to housing 27, holds spring 41 against collar 39. The interior bore of preload collar 39 and spring retainer sleeve 42 form fluid inlet opening or passageway 43 into the valve. On the other side of the valve gate and seat, a passageway or fluid outlet opening 44 is formed in the bore of sleeve 29 with the valve seat 36 rigidly mounted between the bore 44 and the valve chamber 50. The inlet and outlet openings 43, 44 respectively form a straight through passage through the valve when valve openings 46 and 47 respectively in valve seat 36 and gate 38 are aligned. Fluid screen 48 is shown positioned over inlet passageway 43 by means of bolts 49 or the like.

It is desirable to have the seating face of the valve seat 36 smaller than the opposing seating face. In a preferred embodiment, valve seat 36 has upset portion 51 which provides a raised seat face for contacting gate 38. By raising face 51 of seat 36 in a narrow upset portion (see also the dotted lines showing seat face 51 in FIG. 3), the contact area between the gate and seat is minimized and thus the force required to open the valve is held to a minimum.

In this downhole application, where the number of valve actuations for a given power supply may be of a critical nature, the minimization of power usage becomes very important. In this respect, the narrow width of the upset face portion 51 together with the oblong shape of openings 46 and 47 provides a minimum length of travel that the gate and seat must move relative to one another to open and close the valve. The power used to open the valve is proportional to the surface area of the seat face contacting the gate and the distance of relative movement of the ports. Thus, the shape of seat face 51 and openings 46 and 47 is significant in reducing the usage of power to operate the valve.

Gate 38 has a T-slotted end portion which is shaped to receive a mating T-shape formed on end 52 of solenoid stem 53. Stem 53 is vertically arranged in the body of housing 27 and has an "O" ring seal 54 positioned between stem 53 and housing body 27. Stem 53 in turn is connected to armature 56 of valve opening solenoid 57. Solenoid 57 is shown in FIG. 2 in the unactuated position with armature 56 spaced as at 58 from the closed position. This is the configuration of armature 56 when the valve assembly is closed as shown in FIG. 2, i.e. the valve openings 46 and 47 are not aligned.

Armature 56 of solenoid 57 is operatively connected to armature 59 of valve closing solenoid 61 so that the armatures move together as one unit.

Housing 27 extends upwardly from the solenoid housing portion described above to form fluid chamber 73 in which is housed movable piston 74. The walls of housing 27 form a cylinder in which piston 74 moves. O-ring seal 76 on piston seals it within the chamber 73. A port 77 in housing 27 provides a drilling fluid inlet to the top side of piston 74. Oil which fills chamber 73 is thus subjected to the pressure of drilling fluids in the bore of the drill string. This pressure is then passed by the oil which fills the interior of the valve assembly. This communication of drilling fluid pressure to the valve parts provides a pressure balance across the moving parts of the valve to thereby minimize force requirements to operate the valve.

Referring now to FIG. 3 of the drawings, gate 38 is illustrated in its closed position relative to seat 36 with the portion of conduit 47 shown with dotted lines. FIG. 3 illustrates that the thickness of the peripheral wall of upset portion 51 has been minimized to diminish the forces required for moving the valve parts relative to one another. Additionally, FIG. 3 illustrates the respective openings 47 and 46 of the gate and seat as oblong shaped with a width to height ratio as great as possible but preferably 3.5 or more. This minimizes the distance "h" which the gate must move between open and closed positions, which in turn minimizes the power required to operate the system. With respect to power expended to operate the system, it is appreciated that in a downhole configuration the power supply must be sustained as long as possible. Thus, in order to increase the data rate of the system, expediences to facilitate power supply life may become quite important. The oblong shape of the valve ports gives a sufficient volume of flow through the valve to produce a detectable pulse in mud pressure at the surface while minimizing the length of solenoid armature movement, thus conserving power.

FIG. 3 also clearly shows another aspect of the invention involving the through conduit configuration of the valve gate. With this feature, when the valve gate is in the fully open or closed position, the gate covers all or the major portion of sealing face 51 of the valve seat. Abrasive fluid flow through the valve is not wearing the seat in the valve open position. The portion of seat face 51 near opening 46 is only exposed to flow during the very short duration involved in opening and closing the valve. This feature greatly extends the life of the valve parts and likewise increases the possibility of improved data rates without premature failure of the valve. The shear action of the valve arrangement shown herein is also conducive to wiping the seat of the valve upon each movement of the gate between open and closed positions. This wiping action constantly cleans and laps the valve seat.

Because of the floating connection between valve gate 38 and solenoid stem afforded by T-slot connection 52, lateral forces acting on gate 38 are not transmitted to solenoid stem 53. In addition, the gate is free to move in contact with face 51 of seat 36 under the constant biasing action of spring 41. This in turn provides a wear compensating feature in that the gate is always pushing against the seat even as the seat wears.

FIG. 2 of the drawings further illustrates sleeve 29 which is threadedly received in the side of housing 27 and sized to provide an opening when removed that is sufficient to permit removal of both seat 36 from outlet passage 44 as well as gate 38 upon its slippage off of T-slot connection 52 between the gate and stem 53. This side removal feature permits the critical wear parts, i.e. the seat and gate of the valve to be removed at the surface on the floor of the drilling platform without removing the valve assembly from sub 16 and thus without breaking sub 16 out of the pipe string. Such ease of change out of valve parts is a significant time saving feature in the operation of this system.

In the typical operation of the system described above, the tool string illustrated in FIG. 1 is provided with one or more instruments or tools for detecting downhole parameters or the occurrence of downhole events. With any one of a number of detected events, the circuit components of the system provide a signal which, because of its encoded position in a format of signals, is indicative of the occurrence of or value of a specific event. Thus, this signal is sent in the form of an electrical pulse of sufficient time duration to operate solenoid 57 to a solenoid closed position. This in turn will move stem 53 downwardly as viewed in FIG. 2 to align opening 47 in gate 38 with opening 46 in valve seat 36. The movement of the gate is rapid so that a rapid release of drilling fluid occurs through the aligned inlet and outlet openings 43 and 44, respectively. This sudden flow through the valve openings permits drilling fluids under pump pressure in the drill string 34 to be momentarily discharged into borehole annulus 22. This discharge of high pressure drilling fluids from the drill pipe into the low pressure annulus causes a rapid pressure drop in the column of mud in the drill pipe which is observable by transducer 23 in the mud standpipe as a negative pulse. Recordings of the pressure fluctuations observed at transducer 23, when format decoded by electronics 24, can provide a readout at 26 directly indicative of the downhole detected event or valve. (line (b) in FIG. 1)

After the valve gate has been opened by momentary activation of solenoid 57, power to solenoid 57 is ceased whereupon the residual magnetism in the coil of solenoid 57 holds the solenoid sufficiently long to provide a surface detectable pressure pulse. When the valve has opened for a sufficient duration to provide a pulse, the close valve solenoid 61 is operated to move the unitary solenoid armatures toward the valve closed position as illustrated in FIG. 2.

The foregoing description of the invention has been directed in primary part to a particular preferred embodiment in accordance with the requirements of the patent statutes and for purposes of explanation and illustration. It will be apparent, however, to those skilled in the art that many modifications and changes in this specific apparatus may be made without departing from the scope and spirit of the invention. For example, the size, shape and materials as well as the details of the illustrated embodiment may vary. Therefore, the invention is not restricted to the particular form of construction illustrated and described, but covers all modifications which may fall within the scope of the following claims.

It is applicants' intention in the following claims to cover such modifications and variations as fall within the true spirit and scope of the invention.

What is claimed is:

1. A downhole valve apparatus suitable for use in a drilling fluid telemetry system for developing pressure changes in the drilling fluid during a borehole drilling operation utilizing a drill member suspended from a drill string and circulating a drilling fluid down the drill string and up the annulus between the drill string and the borehole wall, comprising:

passage means connecting the interior and the exterior of a tubular member;

shear valve means positioned in said passage means and including a movable gate and a seat rigidly mounted to said tubular member;

means accessible from the exterior of said tubular member for rigidly clamping said seat to said tubular member when in position and for providing an opening for removing said gate and seat from said valve means when removed;

valve operating means for connection to said gate for moving said gate relative to said seat to open said passage means; and floating connection means between said valve operating means and said gate.

2. The apparatus of claim 1 wherein said gate is a through conduit gate arranged so that the sealing face of said rigidly mounted seat of said valve means is substantially covered when said valve means is in an open position.

3. The apparatus of claim 1 wherein the cross-section of the conduit in said valve means seat is oblong, having a width greater than its height, the height being the dimension of said seat that said gate moves across to achieve an open position.

4. The apparatus of claim 3 wherein the width to height ratio of said cross-section is greater than about 3.5 to 1.

5. The apparatus of claim 3 wherein said gate is a through conduit gate arranged so that the sealing face of the seat of said valve means is substantially covered when the conduit in said gate is in an open position and further wherein the conduit in said gate is an oblong opening of the same configuration as the seat in said valve means.

6. A valve apparatus useful in a borehole drilling fluid telemetry system for transmitting data pulses from one end of a pipe string to another by imparting pressure pulses to a drilling fluid circulating down the pipe string, through a drilling member and up the annulus between the pipe string and borehole wall, whereby a valve is operated in the drilling fluid flow path to modulate the flow of the drilling fluid and thereby impart detectable pressure pulses to the drilling fluid, comprising:

inlet and outlet ports in said valve arranged to provide straight through flow path means in said valve between said inlet and outlet ports, said valve having movable gate means and rigidly mounted seat means arranged in a shear valve configuration and having means accessible from the exterior of the pipe string for rigidly clamping said seat means within said outlet port when in position and for providing an access opening for removing said gate means from said valve when removed from position; and valve operating means for moving said gate means in shear relative to said rigidly mounted seat means.

7. The apparatus of claim 6 wherein said rigidly mounted seat means has an oblong valve opening therein having its minor dimension arranged in alignment with the longitudinal axis of said actuating stem, whereby the length of movement of said stem to open said valve is minimized.

8. The apparatus of claim 7 wherein the ratio of the major dimension to said minor dimension of said opening in said seat is at least about 3.5 to 1.

9. The apparatus of claim 5 wherein the conduit in said gate is in constant communication with incoming fluid and directs fluid through the conduit in said seat when the gate is in a valve open position and to the region surrounding the gate for pressure equalization when the gate is in a valve closed position.

10. A downhole valve apparatus for use in a drilling fluid telemetry system during a borehole drilling operation wherein high pressure drilling fluid which is circulated down the central bore in the tubular drill string, through ports in the drilling bit and back up the annular space between the drilling string and the borehole wall is periodically vented from the central bore in the drill string to the annular space to generate a pressure pulse in the drilling fluid for detection at the surface, comprising;

a tubular member connectable as part of the drill string;

an elongate housing mounted within the central opening of said tubular member;

a valve chamber formed within said housing;

an inlet opening for high pressure drilling fluid connecting the outside of said housing and said valve chamber;

an outlet opening for drilling fluid formed through the wall of said housing between the outside of said tubular member and said valve chamber;

a valve seat rigidly mounted within and extending across said outlet opening, said seat having a flow opening therein with a front seating face surrounding the flow opening and being positioned within said valve chamber;

a shear valve gate having a pair of planar faces and a flow opening extending therebetween mounted for reciprocating movement within said valve chamber, one of said planar faces being positioned in sliding engagement with the sealing face of the valve seat and the other of said faces extending across the inlet opening;

means accessible from the exterior of said tubular member for rigidly clamping said valve seat within said outlet opening when in position and for providing an access opening for removing said valve gate from said valve apparatus when removed from position; and means for reciprocating said gate between a valve closed position where the gate face blocks the flow of fluid through the seat opening and a valve open position where the gate flow opening is in alignment with the seat opening to vent high pressure drilling fluid from the inside of the tubular member to the annular space and generate a negative pressure pulse in the fluid.

11. A downhole valve apparatus for use in a drilling fluid telemetry system during a borehole drilling operation as set forth in claim 10 wherein said means for clamping comprises;

a plug removably mounted within said outlet opening and having a central open bore for fluid flow therethrough and flat end surfaces abutting the back face of said valve seat for rigidly mounting said seat within said outlet opening and allowing access from outside the tubular member thereby enabling replacement of said seat.

12. A downhole valve apparatus for use in a drilling fluid telemetry system during a borehole drilling operation as set forth in claim 11 wherein said shear valve gate is removably mounted to said reciprocating means and wherein removal of said plug also allows access to said valve chamber from outside the tubular member when the valve seat is removed for replacement of the valve gate.

13. A downhole valve apparatus for use in a drilling fluid telemetry system during a borehole drilling operation as set forth in claim 10 which also includes;

a cylindrical sleeve member having an open central bore mounted within said inlet opening and including flat end surfaces being positioned in sliding engagement with the face of said gate.

14. A downhole valve apparatus for use in a drilling fluid telemetry system during a borehole drilling operation as set forth in claim 13 wherein the end surfaces of the cylindrical sleeve member are spring biased into engagement with the face of the gate to reduce the possibility of lift off of the gate from the seat.

15. A downhole valve apparatus for use in a drilling fluid telemetry system during a borehole drilling operation wherein an erosive drilling fluid is circulated at high pressure and high flow rates down the central opening in a tubular drill string, through ports in the drilling bit and back up the annular space between the drill string and the borehole wall and wherein the erosive fluid is periodically vented from the central opening in the drill string to the annular space through the valve apparatus which comprises:

a tubular member connectable as part of the drill string;

passage means connecting the interior and the exterior of said tubular member;

shear valve means positioned within said tubular member for selectively opening and closing said passage means, said shear valve means including:

a valve seat rigidly mounted to said tubular member and having a sealing face surrounding a flow aperture through the seat; and a transversely movably mounted valve gate positioned against the sealing face of the valve seat and having a flow aperture therethrough, the size and shape of said gate flow aperture being arranged so that the gate surface substantially covers the sealing face of the valve seat and protects it from exposure to the erosive flow of drilling fluids when the gate and seat aperture are in alignment to permit flow through the valve;

means accessible from the exterior of said tubular member for rigidly clamping said seat to said tubular member when in position and for providing an opening for removing said gate and seat from said valve means when removed;

means for moving said valve gate between a closed valve position where the gate surface engages the sealing face of the valve seat to close the flow aperture and an open valve position where the flow apertures in the seat and gate are aligned to permit flow therethrough; and floating connection means between said valve gate and said means for moving said valve gate.

16. A downhole valve apparatus for use in a drilling fluid telemetry system during a borehole drilling operation as set forth in claim 15, wherein:

the sealing face surrounding the flow aperture in the valve seat is elongate with the shorter dimension being in the direction of movement of the valve gate between open valve and close valve positions.

17. A downhole valve apparatus for use in a drilling fluid telemetry system during a borehole drilling operation as set forth in claim 15, wherein:

the valve seat flow aperture and valve gate flow aperture have substantially the same cross-sectional shape and wherein the dimensions across the gate aperture are less than or equal to the same dimensions across the seat aperture so that the sealing face of the valve seat is fully protected from the erosive flow of drilling fluids when the apertures are in alignment.

18. A downhole valve apparatus for use in a drilling fluid telemetry system during a borehole drilling operation as set forth in claim 17 wherein the dimensions across the gate aperture are less than the same dimensions across the seat aperture.

19. The apparatus of claim 6 wherein the sealing face of one of said gate means or said seat means is smaller than the opposing sealing face to form a sealing rim.

20. The apparatus of claim 6 further comprising through conduit passage means in said gate means arranged so that the sealing face of said seat means is substantially covered when the passage means in said gate means is in an open position.

* * * * *